United States Patent [19]

Kogure et al.

[11] Patent Number: 4,801,968

[45] Date of Patent: Jan. 31, 1989

[54] FIXING DEVICE INCLUDING A HEAT ROLLER HAVING A DEVICE FOR HEATING A REGION OF THE ROLLER CORRESPONDING TO THE WIDTH OF AN IMAGE FORMING MEDIUM

[75] Inventors: Mitutosi Kogure, Yokohama; Yuka Nakamura, Kamakura; Makoto Tamura, Ohta; Keiji Itaya, Yokohama, all of Japan

[73] Assignee: Kabushiki Kaisha Toshiba, Kawasaki, Japan

[21] Appl. No.: 25,766

[22] Filed: Mar. 13, 1987

[30] Foreign Application Priority Data

Mar. 18, 1986 [JP] Japan ..... 61-58108
May 21, 1986 [JP] Japan ..... 61-116996

[51] Int. Cl.[4] ..... G03G 15/20
[52] U.S. Cl. ..... 355/3 FU; 355/14 FU; 355/3 SH; 219/216
[58] Field of Search ..... 355/3 FU, 14 FU, 3 SH; 219/216, 469, 470, 471; 432/60, 228

[56] References Cited

U.S. PATENT DOCUMENTS 4,395,109 7/1983 Nakajima et al. ..... 355/3 FU

FOREIGN PATENT DOCUMENTS 58-172670 10/1983 Japan ..... 355/14 FU
59-171978 9/1984 Japan .
59-171980 9/1984 Japan .
59-197067 11/1984 Japan .
60-3683 1/1985 Japan .
60-263179 12/1985 Japan .

*Primary Examiner*—Arthur T. Grimley
*Assistant Examiner*—J. Pendergrass
*Attorney, Agent, or Firm*—Cushman, Darby & Cushman

[57] ABSTRACT

A fixing device for image forming apparatus utilizing image forming media of a plurality of different widths, comprises a core roller and a supporting roller parallel to and in contact with the core roller to supports the selected one of the image forming media with the toner image thereon and transporting the selected image forming medium, an electrically resistive heat layer on the core roller and a plurality of power supply electrodes for supplying power to at least two portions of the electrically resistive heat layer having sizes corresponding to the widths of at least two of the image forming media.

2 Claims, 7 Drawing Sheets

FIXING DEVICE INCLUDING A HEAT ROLLER HAVING A DEVICE FOR HEATING A REGION OF THE ROLLER CORRESPONDING TO THE WIDTH OF AN IMAGE FORMING MEDIUM

BACKGROUND OF THE INVENTION

1. Field of the Invention

The present invention relates to a fixing device which effects fixing of a toner image on an image forming medium by means of heat rollers in an image forming apparatus.

2. Description of the Prior Art

In general, a means as shown in FIG. 1 has been previously used for fixing toner images formed on various sizes of paper sheets in an image forming apparatus.

In this apparatus, a heat roller 1 includes heater lamps 3 and 4 mounted inside a hollow roller 2. Heater lamp 3 has a heating coil element 3*a* whose length corresponds to the width of an A4 paper sheet 7*a*, and heater lamp 4 has a heating coil element 4*a* whose length corresponds to the width of an A3 paper sheet 7*b*. Each of heater lamps 3 and 4 is selectively heated to around 200° C. and a supporting roller 5 is pressed against heat roller 1. Thermal fixing of toner image 6 is effected on A4 sized paper sheet 7*a* by passing the sheet 7*a* between heat roller 1 and supporting roller 5 while heater lamp 3 is heated. For thermal fixing of a toner image on A3 sized paper sheet 7*b*, heater lamp 4 is heated. Thus, heated region control is effected by using either heater lamp 3 or 4 with different heating widths corresponding to the widths of paper sheets.

However, fixing devices such as this with built-in heater lamps are somewhat bulky, since the roller diameter must be enlarged in order to prevent contact of the heater lamps with each other.

SUMMARY OF THE INVENTION

It is an object of the present invention to provide a fixing device for an image forming apparatus which is compact and permits easy heated region control.

According to one aspect of the present invention, there is provided a fixing device for an image forming apparatus utilizing image forming media of a plurality of different widths, and including means for selecting one of the plurality of image forming media for receiving a toner image, comprising roller means for supporting the selected one of the image forming media with the toner image thereon and transporting the selected medium, and heat generating layer means for heating a region of the roller means corresponding to the width of the selected image forming medium for fixing the toner image on the image forming medium.

Preferably, the roller means includes a core roller and a supporting roller parallel to and in contact with the core roller.

It is also preferred that the heat generating layer means includes an electrically resistive heat layer on the core roller.

It is also preferred that the heat generating layer means also includes means for selectively supplying power to a portion of the electrically resistive heat layer.

The heat generating layer means includes a plurality of electrically resistive layers on the core roller, and insulating means for electrically separating the layers.

The supplying means includes a plurality of power supply electrodes for supplying power to at least two portions of the electrically resistive heat layer having sizes corresponding to the widths of at least two of the image forming media.

BRIEF DESCRIPTION OF THE DRAWINGS

These and other objects and advantages of this invention will become more apparent and more readily apprecited from the following detailed description of the presently preferred exemplary embodiments, taken in conjunction with the accompanying drawings of which.

DETAILED DESCRIPTION OF THE PREFERRED EMBODIMENTS

One of the preferred embodiments of the present invention will be described with reference to the accompanying drawings.

In the present invention, a fixing device for image forming apparatus utilizing paper sheets as image forming media of a plurality of different widths, and including selecting means for selecting one of the plurality of paper sheets for receiving a toner image, the device comprises a core roller and a supporting roller parallel to and in contact with the core roller to supports the selected one of the paper sheets with the toner image thereon and transporting the selected paper sheet, an electrically resistive heat layer on the core roller, and a plurality of power supply electrodes for supplying power to at least two portions of the electrically resistive heat layer having sizes corresponding to the widths of at least two of the paper sheets.

Figure 1:
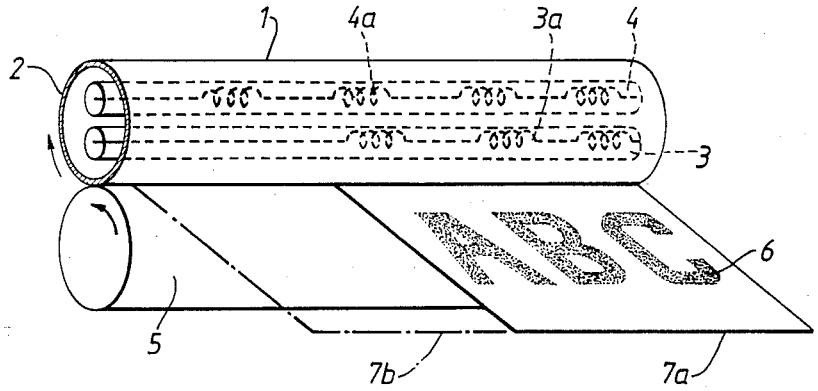
FIG. 1. PRIOR ART
FIG. 1 is a perspective view showing a conventional fixing device.
Figure 2:
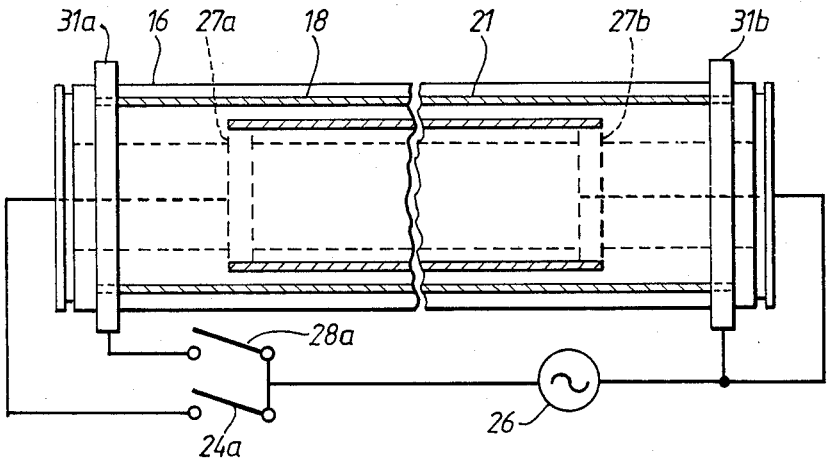
FIG. 2 is a schematic view showing a heating roller of a fixing device according to one embodiment of the present invention.
Figure 3:
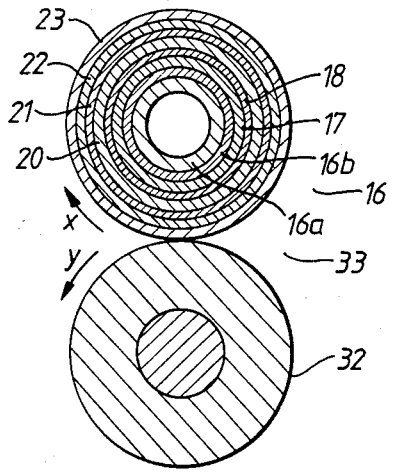
FIG. 3 is a schematic cross-sectional view showing the fixing device shown in FIG. 2.
Figure 4:
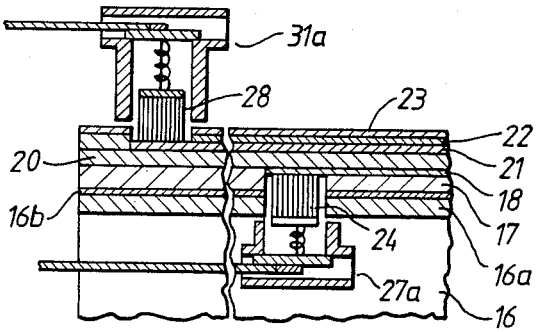
FIG. 4 is a ragmentary sectional view showing power supply electrodes for the heat roller shown in FIG. 2.

FIGS. 2 to 4 show a fixing device according to the present invention. Reference number 16 denotes a heat roller with an outer diameter of about 35 mm. A composite layer 16*b* comprising an aluminium oxide ($Al_2O_3$), magnesium oxide (MgO) and nickel (Ni) alloy is provided on a core metal roller 16*a* of iron (Fe). This composite layer 16*a* prevents cracking occurring due to the difference in the coefficients of thermal expansion of the core metal roller 16a and a ceramic member formed on the roller 16a. On composite layer 16b there is provided a first electrically insulating layer 17 of aluminium oxide ($Al_2O_3$) about 1 mm thick, and on this layer 17 there is provided a first electrically resistive layer 18 of barium titanate ($BaTiO_3$) forming a heat layer which is about 100 μm thick. The width of first electrically resistive layer 18 in the longitudinal direction of heat roller 16 is slightly greater than the width of an A4 size sheet of paper (Width x Length=210 mm×297 mm). First electrically resistive layer 18 is successively overlaid with a second electrically insulating layer 20 that is the same as first electrically insulating layer 17, and a second electrically resistive layer 21 of barium titanate ($BaTiO_3$). The second resistive layer is about 100 μm thick and has a width in the longitudinal direction of heat roller 16 which is slightly greater than the width of an A3 size sheet of paper (Width x Length=297 mm×420 mm). A third electrically insulating layer 22 that is the same as first electrically insulating layer 22 covers the second resistive layer. All of these layers formed on core metal roller 16a are formed by plasma spraying. Finally, the outer surface of heat roller 16 is covered with a surface layer 23 of polyfluroalkyl vinyl ether (PFA). Ring-shaped first power supply electrodes 27a and 27b are supplied with power from a 100V, 800 W AC power source 26 through a first switch 24a, and are in sliding contact with opposite sides of first electrically resistive layer 18 via first power supply brushes 24. Ring-shaped second power supply electrodes 31a and 31b are supplied with power from AC power source 26 through a second switch 28a, and are in sliding contact with opposite sides of second electrically resistive layer 21 via second power supply brushes 28. Reference number 32 denotes a supporting roller that is in pressure contact witth heat roller 16, and heat roller 16 and supporting roller 32 together constitute a pair of fixing rollers 33.

In copying, a fixing process is started as the result of the start of the image forming process, and if the size of the paper sheet specified on a control panel (not shown) is A4 size or smaller than A4 size, first switch 24a is switched on and a current of about 3 A is supplied into first electrically resistive layer 18 by first power supply electrodes 27a and 27b. Hereupon, a portion of the surface of heat roller 16 that corresponds to the width of a sheet of size A4 paper, which also corresponds to the length of first electrically resistive layer 18, is rapidly heated to about 200° C. At the same time, heat roller 16 and supporting roller 32 are respectively rotated in the directions of arrow x and arrow y and a sheet of paper (not shown) on which a toner image has been formed by passage through a transfering process passes between heat roller 16 and supporting roller 32, thereby heating and fixing the toner image. Then the sheet of paper is discharged to complete the copying operation. If a sheet of paper with a width greater than that of A4 size is specified on the control panel (not shown), first switch 24a is turned off and second switch 28a is turned on, and a current of about 5 A is supplied into second electrically resistive layer 21 by second power supply electrodes 31a and 31b. Hereupon, the surface of heat roller 16 is rapidly heated to about 200° C. over a whole A3 size width, or the equivalent of the length of second electrically resistive layer 21. A sheet of paper that has passed through a transferring process passes between heat roller 16 and supporting roller 32, thus heaating and fixing its toner image. The paper is then discharged.

With this embodiment described above, since it is possible to change the electrically resistive layer used depending on the size of sheet of paper and heat only the required portion of heat roller 16, it is possible to reduce the size of the fixing device as compared to a conventional device in which plural heater lamps are provided inside a hollow roller.

The invention is not limited to the above embodiment but it is possible to have a variety of design modifications. For example, the thickness and method of formation of the various layers may be any arbitrary dimensions or methods. Also, there are no restrictions on the widths or number of electrically resistive layers and as long as these layers constitute resistance members the material used for them may be other titanium oxide ($Ti_2O$) ceramics, nickel oxide (NiO) or cobalt oxide ($Co_2O_3$), etc.

Figure 5:
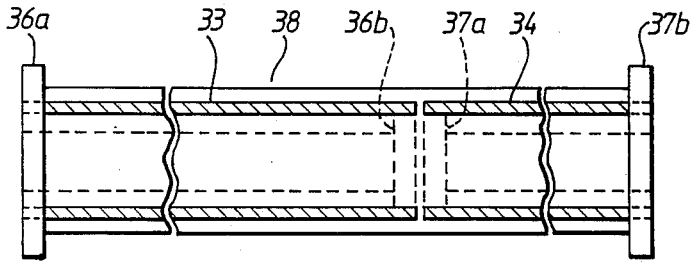
FIG. 5 is a schematic view showing a heating roller of a fixing device according to another embodiment of the present invention.

Also, as shown in the modification example of FIG. 5, one may have a first electrically resistive layer 33 and a second electrically resistive layer 34 adjacent to one another. In this configuration, the temperature distribution on the surface of a heat roller 38 maybe varied by supplying power only via first power supply electrodes 36a and 36b in the case of a small-sized sheet of paper, and by supplying power both to first power supply electrodes 36a and 36b and to second power supply electrodes 37a and 37b in the case of a large-sized sheet of paper. Further, there are no restrictions on the type of power source or the magnitude of power it supplies, etc. and any arbitrary values maybe used for the set temperature of the heat roller surface during heating.

Another embodiment of the present invention will be described hereinafter.

Figure 6:
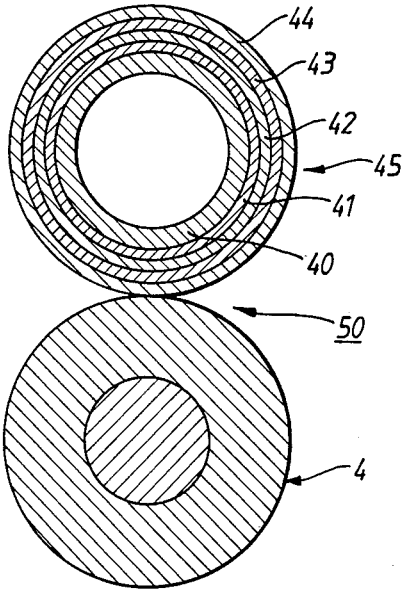
FIG. 6 is a schematic cross-sectional view showing a fixing device according to further embodiment of the present invention.
Figure 7:
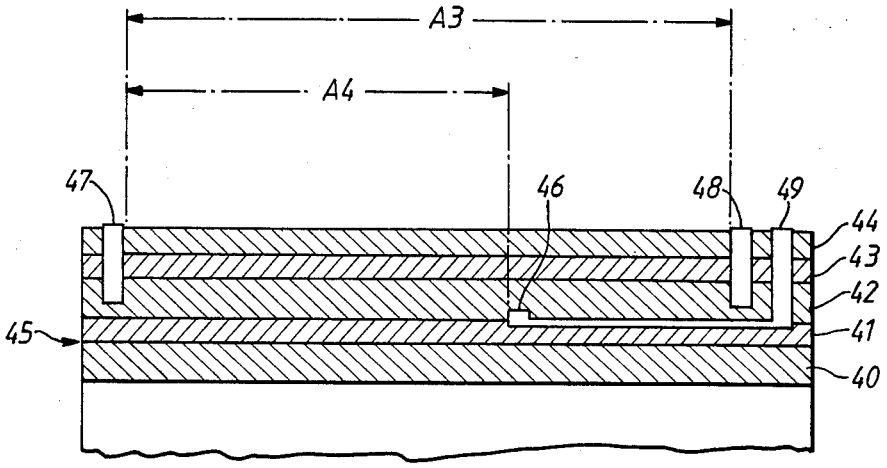
FIG. 7 is a fragmentary sectional view showing power supply electrodes for the heat roller shown in FIG. 6.
Figure 8:
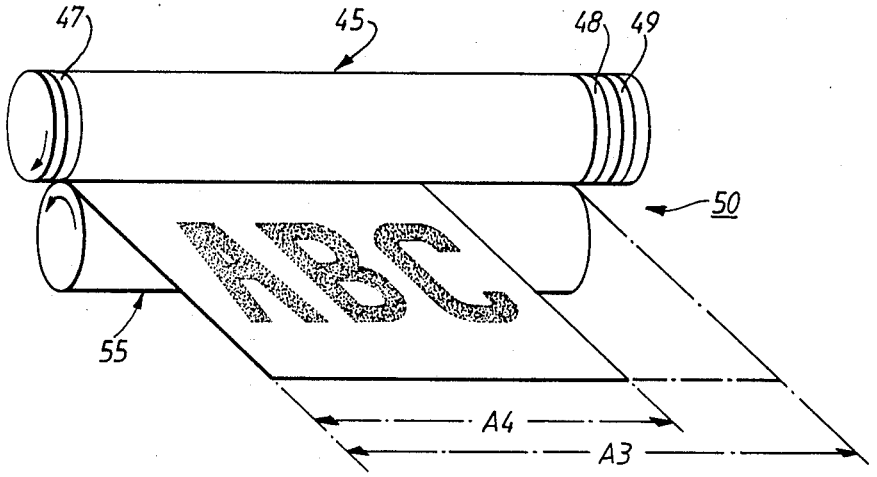
FIG. 8 is a perspective view showing the fixing device shown in FIG. 6.

FIGS. 6 to 8 show a fixing device in another embodiment of the present invention.

A heat roller 45 has a core metal roller 40, and an electrically insulating layer 41 formed on core metal roller 40. A lead electrode 46 which is provided in an upper portion of electrically insulating layer 41 serves to heat an electrically resistive layer 42 over distances that are slightly wider than the width of an A4 size sheet of paper. Electrically resistive layer 42 is formed covering lead electrode 46. Power supply electrodes 47, 48 and 49 are provided in roll side edge portions to permit supply of power to electrically resistive layer 42. That is, power supply electrode 47 is positioned at the left side end of heat roller 45 corresponding to the left side edge of all size sheets of paper. Lead electrode 46 connected to power supply electrode 49, is positioned at a position corresponding to the right side edge of an A4 size sheet of paper, as described above. Power supply electrode 48 is positioned at the right side end of heat roller 45 corresponding to the right side edge of an A3 size sheet of paper. An electrically insulating layer 43 is formed on electrically resistive layer 42 and a surface layer 44 that permits good separation of toner is formed on electrically insulating layer 43.

Ceramic, alumina or silicon oxide, etc. maybe used for both electrically insulating layers 41 and 43 and both these layers are formed to a thickness of 0.1–1.0 mm by plasma spraying. Electrically resistive layer 42 is constituted by 0.1–1.0 mm thick ceramic or $TiO_2$, etc. Surface layer 44 is constituted by a 0.01–0.05 mm thick layer of polyfluoroalkyl vinyl ether or polytetrafluroethylene, etc.

Though the distance between power supply electrode 47 and lead electrode 46 corresponds to the width of an A4 size sheet of paper, as described above, the distance is made slightly greater than the width of A4 size sheet of paper. Also though the distance between power supply electrode 47 and power supply electrode 48 corresponds to the width of an A3 size sheet of paper, the distance is made slightly greater than the width of an A3 size sheet of paper. The voltage supplied between the power supply electrodes is set at values matching each different paper width.

Power supply brushes (not shown) slidably contact with power supply electrodes 47, 48 and 49, respectively, to supply electric power from the power source.

Reference number 55 denotes a supporting roller having a length which is the same length as the distance between power supply electrodes 47 and 48. That is, supporting roller 46 contacts with the portion of heat roller 45 between power supply electrodes 47 and 48 using pressure, and heat roller 45 and supporting roller 46 together constitute a pair of fixing rollers 50. That is, power supply electrodes 47, 48 and 49 are positioned so as to make no contact with supporting roller 55.

Figure 9:
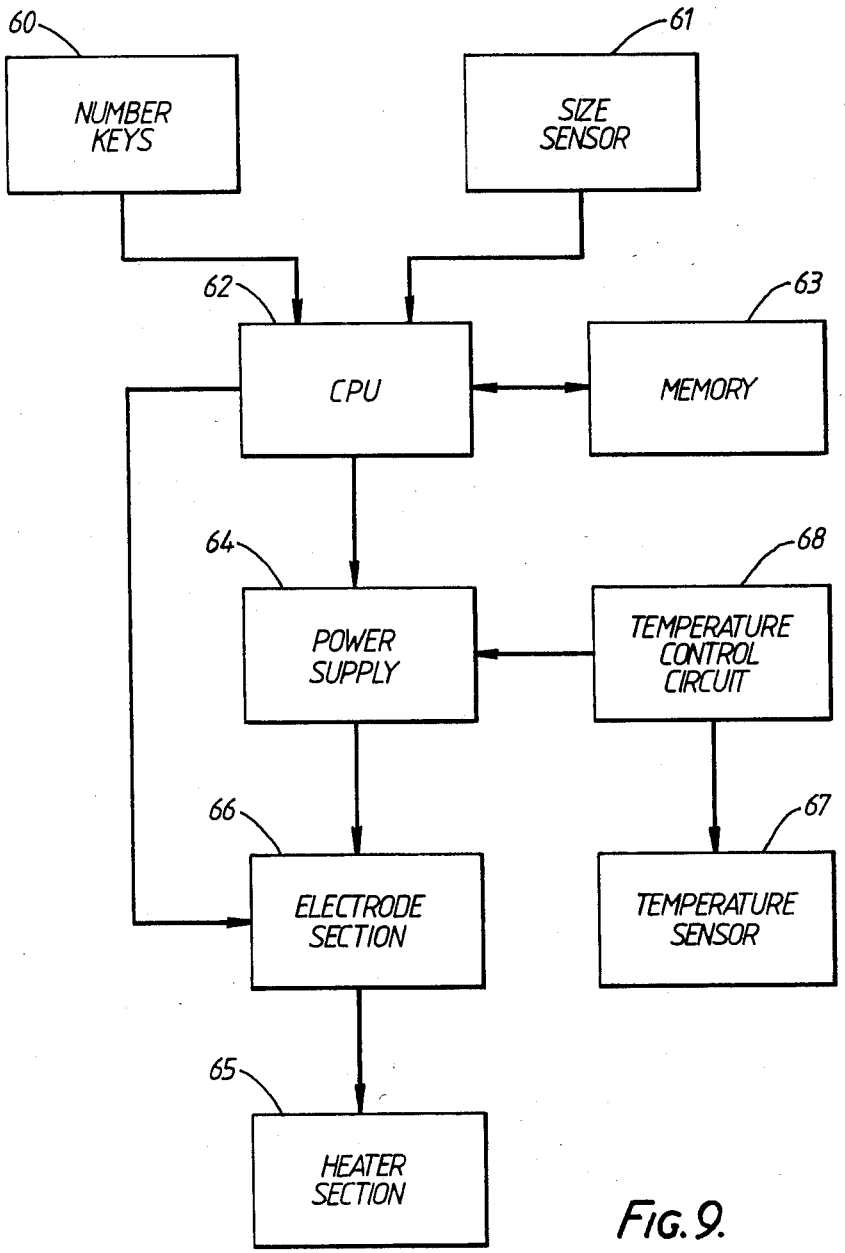
FIG. 9 is a block diagram showing the control system for heating region of the heating roller shown in FIG. 7.

FIG. 9 is a block diagram showing the configuration of the control system for controlling the heating region in this embodiment.

This control system consists of number keys 60 by which th number of copies is input, a size sensor 61 which detects the size of a sheet of paper with machine paper supply, and a CPU 62 and a memory 63 which serve to control the heating region in correspondence to the number of copies and size of sheets of paper. A power supply 64 is switched on and off by CPU 62. An electrode section 66, in which CPU 62 selects power supply electrode 48 or 49, heats a heater section 65 constituted by electrically resistive layer 42. Further, this system consists of a temperature sensor 67 which detects the temperature of heat roller 45 heated by heater section 65, and a temperature control circuit 68 which effects on/off control of power supply 64 in response to temperature sensor 67 output.

Figure 10:
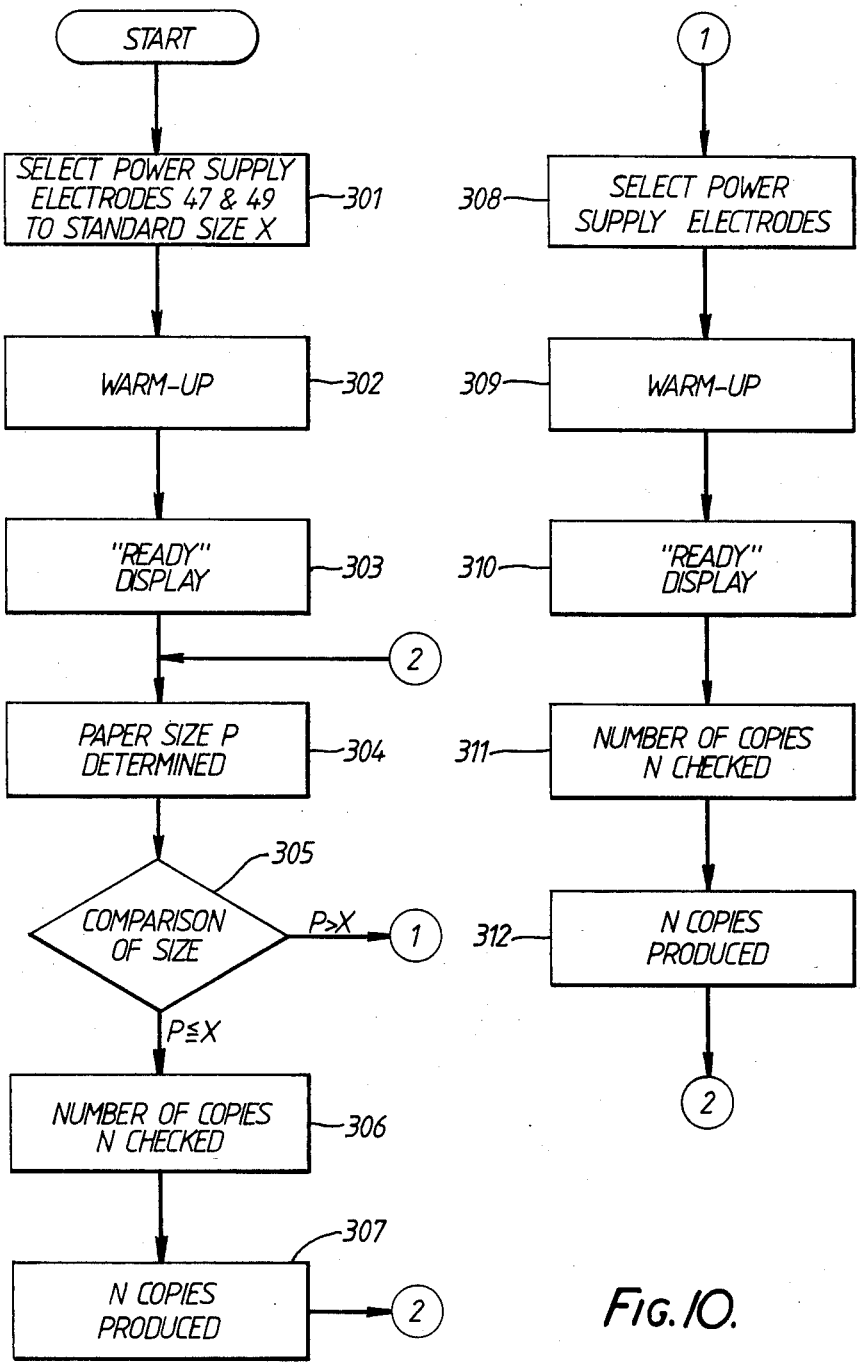
FIG. 10 is a flowchart showing operation of the fixing device.

FIG. 10 is a flowchart showing operation of this control system.

First, CPU 62 turns power supply 64 on and simultaneously selects power supply electrodes 47 and 49 to make electrode section 66 correspond to the width of an A4 size sheet of paper as a standard size (X) (step 301).

With the system in this state, heat roller 45 is preheated by heater section 65 (step 302). Then, when the roll surface has reached a set temperature, a "Ready" display is indicated to indicate that a copying operation is possible (step 303).

Also, the sheet of paper size P is determined (step 34) and compared with the width X between the electrodes (step 305).

If $P \leqq X$, e.g., A4 size, the number of copies n designated by number keys 60 is determined (step 306) and n copies are produced. Electric power is supplied from power supply 64 to the region between power supply electrodes 47 and 49, and this heats electrically resistive layer 42 only between power supply electrode 47 and leads electrode 46 (step 307).

If $P > X$, e.g., A3 size, electrodes with an interelectrode distance greater than X are picked out and electrodes 47 and 48 are selected (step 308). At this stage, a "Wait" display is given and the roll surface is heated by heating portion of electrically resistive layer 42 between electrode 47 and 48 (step 309). This raises the temperature of portions to which power has not been supplied previously. After a set time, a "Ready" display is given (step 310), the number of copies n that has been input is checked (step 311) and copying is effected with reference to the number of copies n (step 312).

On completion of the above copying operation, the system returns to step 304 and the action proceeds to a new copying operation.

Figure 11:
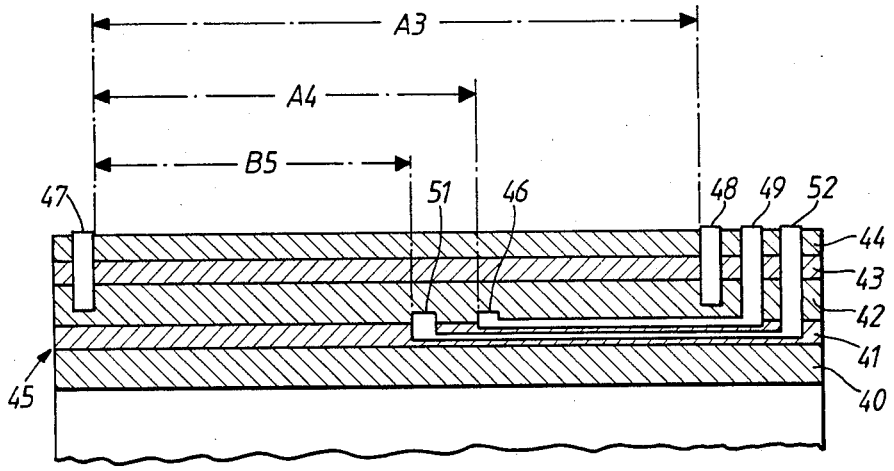
FIG. 11 is a fragmentary sectional view showing power supply electrodes for a heat roller of a fixing device according to still further embodiment of the present invention.
Figure 12:
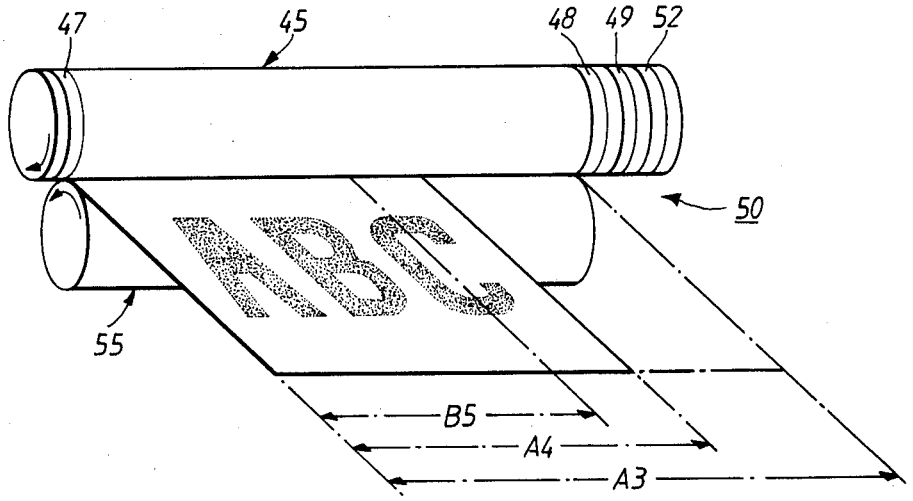
FIG. 12 is a perspective view showing the fixing device shown in FIG. 11.

FIGS. 11 and 12 show cross-sectional and perspective views of a fixing device in another embodiment of the present invention.

In addition to the elements of the embodiment described above, this embodiment is also provided with a lead electrode 51, and an electrode 52 in a roller side edge portion. Lead electrode 51 is positioned inside the lead electrode 46 to define a width corresponding to the width of B5 size sheet of paper (Width x Length = 182 mm × 257 mm). Though the distance between power supply electrode 47 and lead electrode 51 corresponds to the width of a B5 size sheet of paper, as described above, the distance is made slightly greater than the width of a B5 size sheet of paper.

The thermal response is fast in the above embodiments, since the heating rollers are constituted by electrically resistive layers, and not by heat lamps. In addition, it is possible to reduce power consumption, since selection of paper size is accompanied by simultaneous selection of power supply electrodes.

Further, since only required regions are heated, thermal deterioration of the heating roller is prevented and it is possible to control increases in the temperature of the image forming apparatus in which the fixing device is employed.

Also, the use of lead electrodes makes it possible for electrodes to be positioned on side end portions of the heating roller for connection to the heater power supply, thus preventing hindrance to the fixing operation.

What is claimed is:

1. A fixing device for an image forming apparatus utilizing image forming media of a plurality of different widths, and including means for selecting one of the plurality of image forming media, comprising:

a heat roller including a core roller and an electrically resistive layer region formed on the core roller for carrying an electric current to generate heat, said electrically resistive layer including:

a first electrically resistive layer having a length corresponding to a first width of one of the plurality of image forming media, a second electrically resistive layer having a length corresponding to a second width of another of the plurality of image forming media, and an electrically insulating layer between the first and second electrically resistive layers;

a supporting roller disposed parallel to said heat roller for supporting the selected one of the image forming media in a contacting relationship with heat roller; and means for selectively supplying electrical power to a portion of the electrically resistive layer region corresponding to the width of the selected image forming medium.

2. The device of claim 1 wherein the supplying means includes:

first power supply electrodes on opposite sides of the first electrically resistive layer for receiving power; and second power supply electrodes on opposite sides of the first electrically resistivelayer for receiving power; and second power supply electrodes on opposite sides of the second electrically resistive layer for receiving power.

* * * * *